US005946958A

United States Patent [19]

Clark et al.

[11] Patent Number: 5,946,958

[45] **Date of Patent: *Sep. 7, 1999**

[54] DEVICE FOR MANUFACTURING A GROOVE BEARING

[75] Inventors: Wesley Ronald Clark, Watsonville; Roger Allen Addy, Gilroy; Samnathan Murthy; David Jennings, both of Santa Cruz, all of Calif.

[73] Assignee: Seagate Technology, Inc., Scotts Valley, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/691,503

[22] Filed: Aug. 2, 1996

Related U.S. Application Data

[63] Continuation-in-part of application No. 08/631,568, Apr. 12, 1996, abandoned.

[51] Int. Cl.[6] ..... B21D 17/04

[52] U.S. Cl. ..... 72/75

[58] Field of Search ..... 72/75, 113, 117, 72/126

[56] References Cited

U.S. PATENT DOCUMENTS

| | | | |
|---|---|---|---|
| 2,739,726 | 3/1956 | Bregen | 72/126 |
| 3,688,537 | 9/1972 | Schneider | 72/75 |
| 3,818,734 | 6/1974 | Bateman | 72/75 |
| 3,924,434 | 12/1975 | Fulier | 72/208 |
| 4,866,966 | 9/1989 | Hagen | 72/75 |
| 5,269,164 | 12/1993 | Choi | 72/75 |
| 5,520,038 | 5/1996 | Clark et al. | 72/75 |

FOREIGN PATENT DOCUMENTS

| | | | |
|---|---|---|---|
| 845977 | 7/1981 | Russian Federation | 72/75 |

*Primary Examiner*—Lowell A. Larson
*Attorney, Agent, or Firm*—Flehr Hohbach Test Albritton & Herbert LLP

[57] ABSTRACT

An apparatus for forming grooves in the surface of an article is disclosed. The apparatus includes a cage which has a circular cage wall with an annular pattern of holes in the wall. The apparatus also includes a plurality of spherical balls, each rotatably disposed in a respective hole of the cage wall and has a diameter greater than the wall thickness. The apparatus further includes a pin located within the cage, the pin has a circumferential groove in a plane coincident with the plurality of spherical balls and holes in the cage wall so that the pin holds the balls in the groove, the balls protruding through the cage wall and engaging the surface of a workpiece to be grooved so that the balls roll in the groove in the pin and, with movement of the workpiece and the apparatus, cause grooves to be formed in the interior surface of the workpiece. Lastly, the apparatus further includes an object at either end of the pin for holding the pin against translational movement relative to the cage with movement of the apparatus and the workpiece so that only a rotational movement is imparted to the pin by rotation of the workpiece.

7 Claims, 4 Drawing Sheets

DEVICE FOR MANUFACTURING A GROOVE BEARING

CROSS REFERENCE TO RELATED APPLICATIONS

This application is a continuation-in-part of now abandoned U.S. patent application Ser. No. 08/631,568, filing date Apr. 12, 1996, Attorney's Reference A59175-1, entitled, "DEVICE FOR MANUFACTURING A GROOVE BEARING, by inventors Wesley Clark and David Jennings; incorporated herein by reference.

FIELD OF THE INVENTION

This invention relates generally to hydrodynamic groove bearings formed with pumping grooves, and more particularly to a device for manufacturing such a hydrodynamic groove bearing.

BACKGROUND OF THE INVENTION

The present invention relates to a device for manufacturing a groove bearing having a bearing shaft and a bearing bush with cooperating bearing surfaces, of which at least one bearing surface is formed with a pattern of pumping grooves.

A device for forming such grooves has been taught in EPA2292. This device, shown in FIG. 1 hereof, comprises a hard pin 1 around which a cylindrical cage 2 is arranged which has one or more annular patterns of holes arranged symmetrically about the central axis of the cage. These holes are engaged by hard balls 4 having a diameter larger than the wall thickness of the cage. The cage and the pin or sleeve are each coupled to a drive arrangement capable of impressing a translation and a rotation upon the cage and the pin or sleeve. Thus, the cage 2 and pin 1 are separately translated and/or rotated in order to form the grooves 6 in the surface of the bearing wall 5.

According to the patent owner's own later filed U.S. Pat. No. 5,265,334, it has been found that in carrying out the prior art method that the pin or sleeve of the prior art device is subjected to substantial wear as a result of large Hertzian stresses produced at the contact surfaces between the pin or sleeve and the balls. The wear particularly causes deformations of the pin surfaces surrounding and facing the cage, so that the contact surface of the pin or sleeve becomes irregular resulting in inaccurate groove depth. Therefore, this same U.S. Patent '334 discloses a improvement shown in FIG. 2 of the present application in which the bearing surface of the bearing part (which may be a pin or sleeve) includes a continuous groove 7 which is concentric with the central axis of the pin or sleeve, the groove extending in a longitudinal sectional plane of the pin 1 which contains the central axis. Either the pin 1 or cage 2 is then exclusively both rotated and translated to form the grooves 6.

It has further been found that it is difficult to form the grooves by driving either the pin or the cage in both rotation and translation without the development of application specific, expensive machinery.

Also, the equipment and device as described above, and other known devices in the field, have been unable to successfully groove steel on a reliable basis. As a result, hydrodynamic bearings in motors developed to date have been typically formed of softer materials such as brass, limiting their lifetime. The development of a device and method for successfully grooving steel would lead to less expensive hydrodynamic bearing and hydrodynamic bearing equipped motors, and bearings having a longer lifetime.

SUMMARY OF THE INVENTION

It is an object of the present invention to improve upon the known devices for forming grooves for a hydrodynamic bearing.

Another objective of the invention is to provide a method and device which simplifies making grooves for hydrodynamic bearings which are regularly spaced and have a consistent depth.

It is a further objective of the present invention to provide a device which simplifies making grooves for hydrodynamic bearings in that the driving forces for providing relative rotation and translation can be provided by equipment of a standard design. A related objective of the invention is to provide a means for forming grooves for a hydrodynamic bearing using a standard indexing lathe.

It is a further objective of the invention to provide a device and method for forming the grooves for a hydrodynamic bearing which is capable of forming grooves in steel, or other unusually hard materials.

To achieve these and related objectives, the device in accordance with the present invention is characterized by a cage which has a pattern of holes surrounding in concentric width a central axis of the cage, and a short hard pin located within a recess defined by the cage. The pin is free to rotate about the cage's central axis, but is held so that it cannot translate along the long axis of the cage. A number of grooving balls, preferably made out of carbide, are preferably equally spaced about the central axis of the pin, and lie in one plane perpendicular to the axis of the tool.

To facilitate assembly of the tool, the outer diameter of the cage is reduced between the location of the groove and grooving balls, and the open end of the tool. Thus, the interior of the cage may receive in succession a locating ball, the rotatable pin, and a second locating ball. The grooving balls are placed in the groove of the pin, and an end cap is slipped over the end of the grooving tool. The cap extends over the tool body's reduced diameter outer surface so that the end of the cap wall defines a position of the cage holes which hold the grooving balls. Thus, the tool is easily assembled and the grooving balls reliably kept in their defined location.

To form the grooves on the surface of the bushing for the hydrodynamic bearing, the tool is inserted into the workpiece which is to be grooved, and axially translated through that opening while the bushing or workpiece on which the groove is to be formed is rotated. The shape of the pattern is defined by the combination of the workpiece rotation and the axial tool translation.

Other features and advantages of the present invention will become apparent to a person of skill in the art who studies the following disclosure of a preferred embodiment, given with reference to these figures.

BRIEF DESCRIPTION OF THE DRAWINGS

The invention will be described in further detail by way of example with reference to the drawings in which.

DETAILED DESCRIPTION OF A PREFERRED EMBODIMENT

Figure 1:
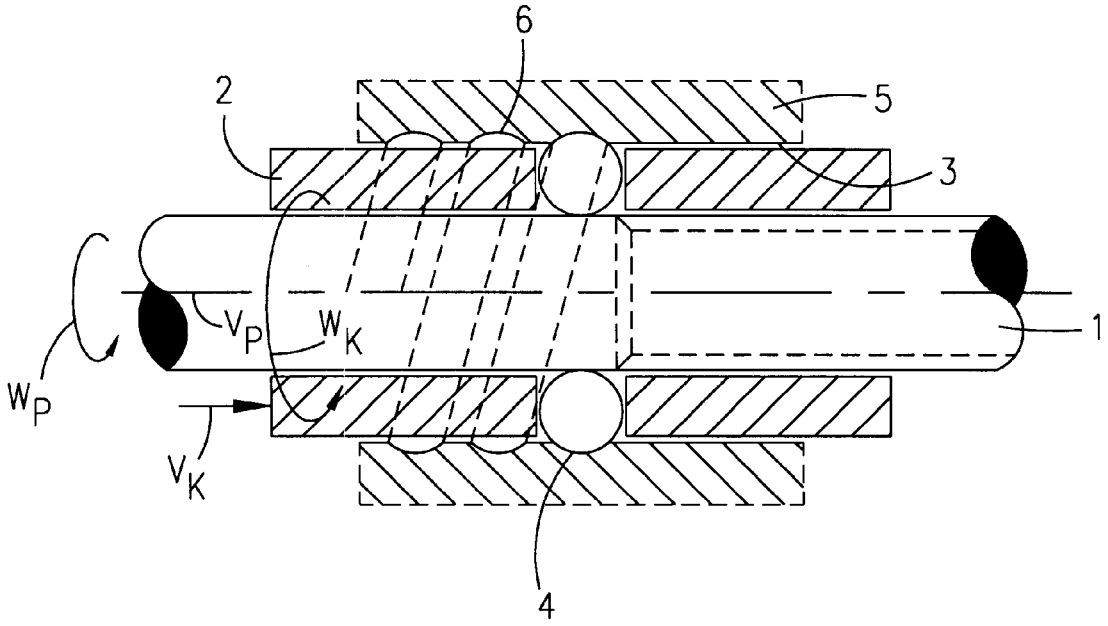
FIG. 1 PRIOR ART
FIG. 1 is a diagrammatic drawing of a prior art device used to form grooves in a hydrodynamic bearing surface.
Figure 2:
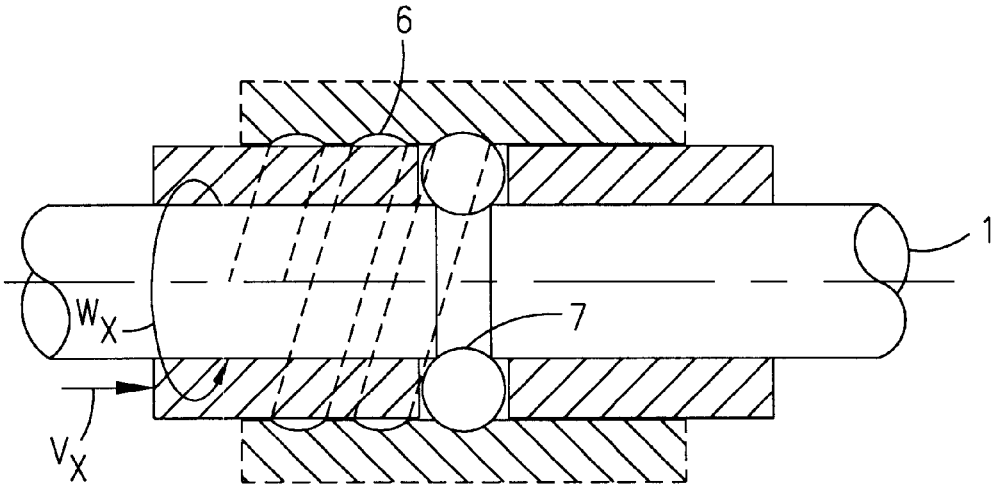
FIG. 2 PRIOR ART
FIG. 2 is a depiction of a further prior art device for forming grooves on a surface of a bearing to be formed.
Figure 3A:
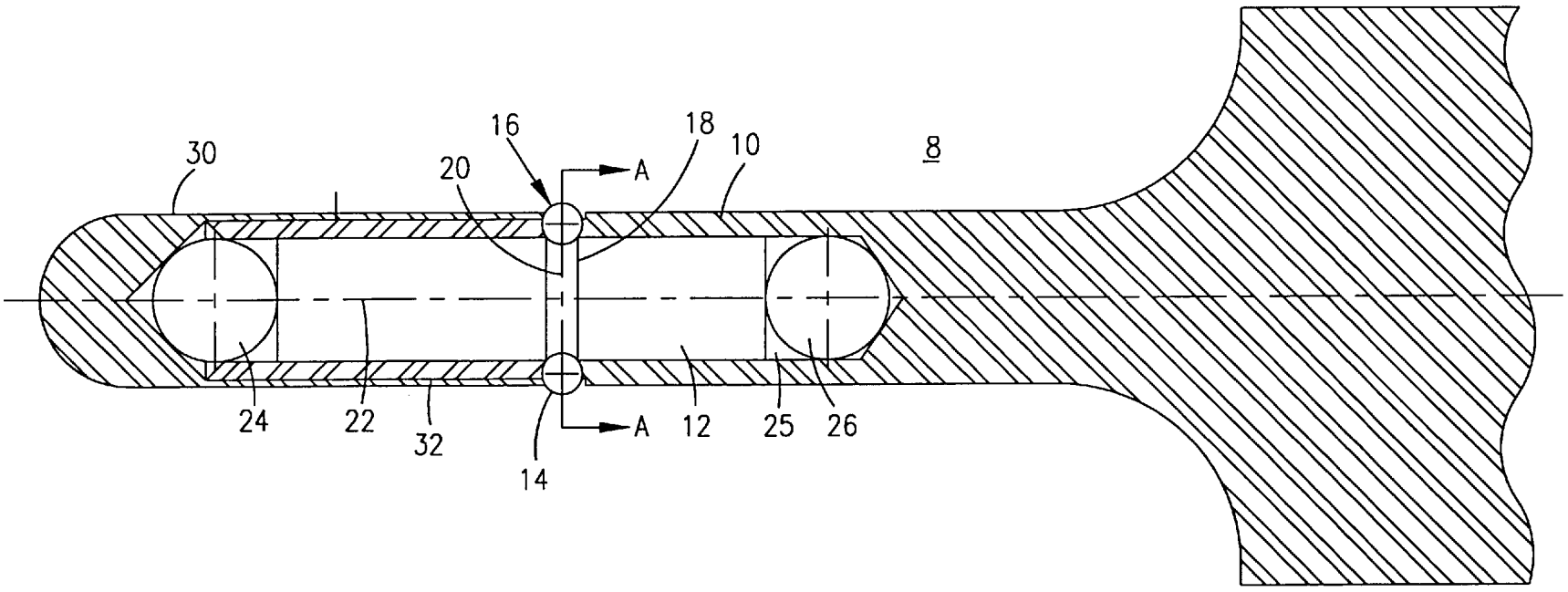
FIG. 3A is a vertical sectional view of the Seagate grooving tool of the present invention.
Figure 3B:
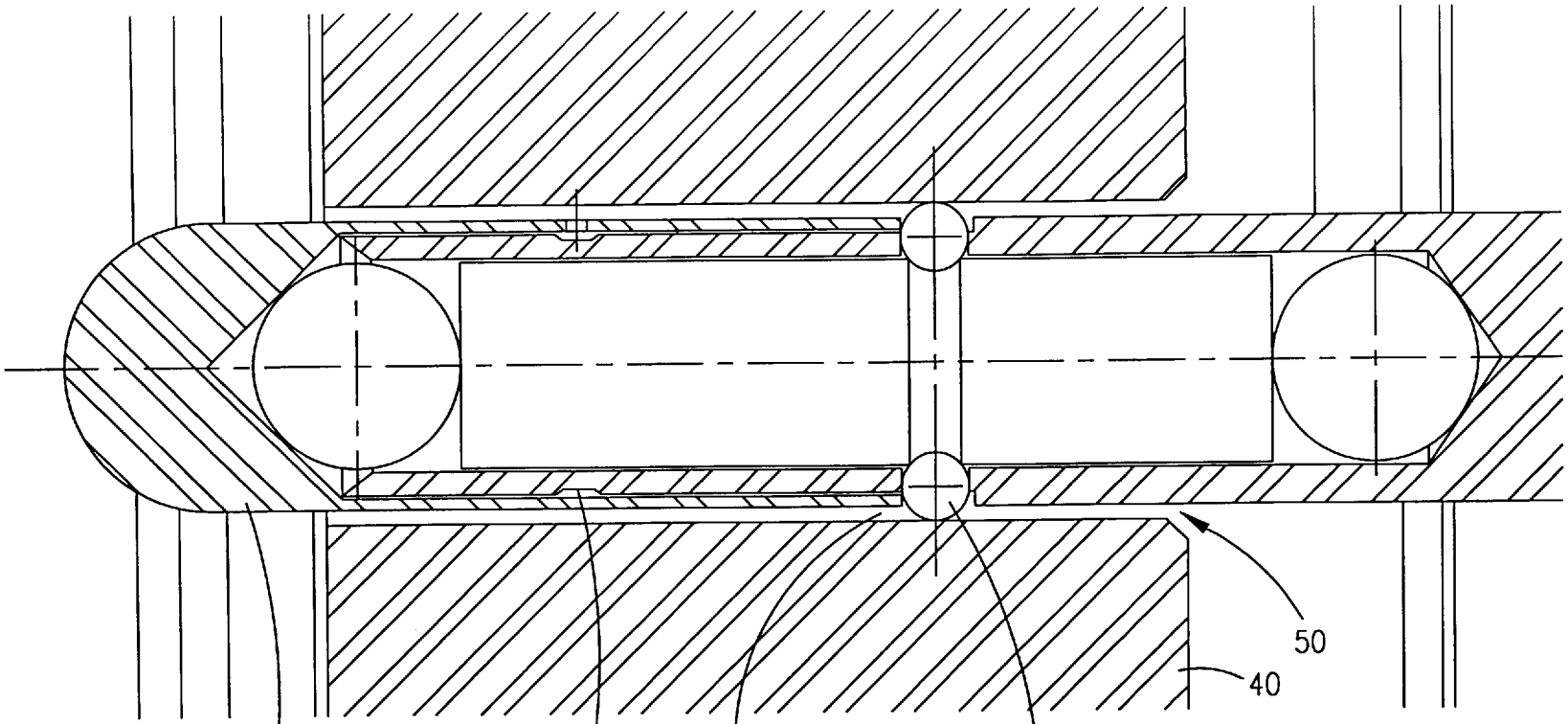
FIG. 3B is a vertical sectional view of the Seagate grooving tool, enlarged, shown relative to a workpiece to be grooved.
Figure 3C:
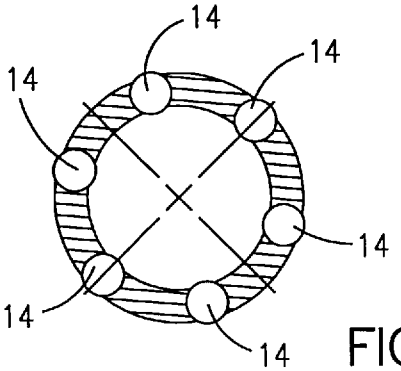
FIG. 3C is a view of the grooving balls held in the groove 18 taken along section line AA of FIG. 3A.

Turning to FIG. 3A, the device of the present invention for forming grooves comprises a cylindrical cage 10, a bearing pin 12, and a plurality of ceramic or hardened, isostatically compressed metal balls 14 arranged in openings 16 in the cage and also held in place by resting in a groove 18. The balls 14 are engaged in the holes 16, preferably in an annular pattern which is symmetrical about the central axis and causes the balls to be held in substantially the same plane 20 perpendicular to the central axis 22 of the pin (see FIG. 3C).

The grooving balls 14 are preferably formed of carbide, specifically tungsten carbide, so that they are hard enough to form grooves in materials such as steel, which up to this time have proven extremely difficult to groove with the precise grooves needed for a hydrodynamic bearing. The tool bearing pin 12 is made out of a material with a very high Youngs's modulus, such as 65 MPSI. The pin is typically formed of carbide, and more specifically, tungsten carbide; in one form, the pin comprises approximately 16% cobalt and approximately 84% tungsten carbide. Successful devices have been fabricated utilizing commercially available carbide gauging balls and a carbide gauging pin. The use of a pin and balls of the requisite hardness and precise dimensions enables the tool to form grooves precisely on the way into a workpiece bore as well as on the way out of the workpiece.

The pin 12 as can be seen, is free to rotate inside the cage 10. Thus, as will be seen later with reference to FIG. 3B and FIG. 4, as the workpiece is rotated, the rotational movement of the workpiece is coupled by the ball to the pin 12, causing such rotation. However, retainer balls 24, 26 are provided at either end of the internal space in which the pin rests, so that the pin cannot translate along the long axis 22 of the device.

To assemble the grooving tool 8, the first retainer ball 26 is inserted into the interior 25 of the cage, followed by the pin 12 and the second retainer ball 24.

The hardened grooving metal balls 14 are then arranged in the holes in the cage, and the bullet nosed cap or cage piece 30 slides over the reduced diameter region 32 of the basic cage element 10. As can be seen better in FIG. 3B, the end 35 of the cap 30 is formed with a tapered surface to engage the outer portion of the grooving ball 14. In this way, the cap 30 holds the grooving balls in place in their holes in the cage, leaving them free to rotate and form grooves in the workpiece 40. Because of this assembly method, as the balls wear down from continuing use, they may be replaced by withdrawing the cap 30, replacing the balls, and then replacing the cap 30 over the reduced diameter section 32 of the cage.

A groove 42 is also provided in this reduced outer diameter section of the cage; adhesive may be placed in this groove in order to lock the cage to the cap 30 so that the balls are held in place within the grooving tool while remaining free to rotate.

Figure 4:
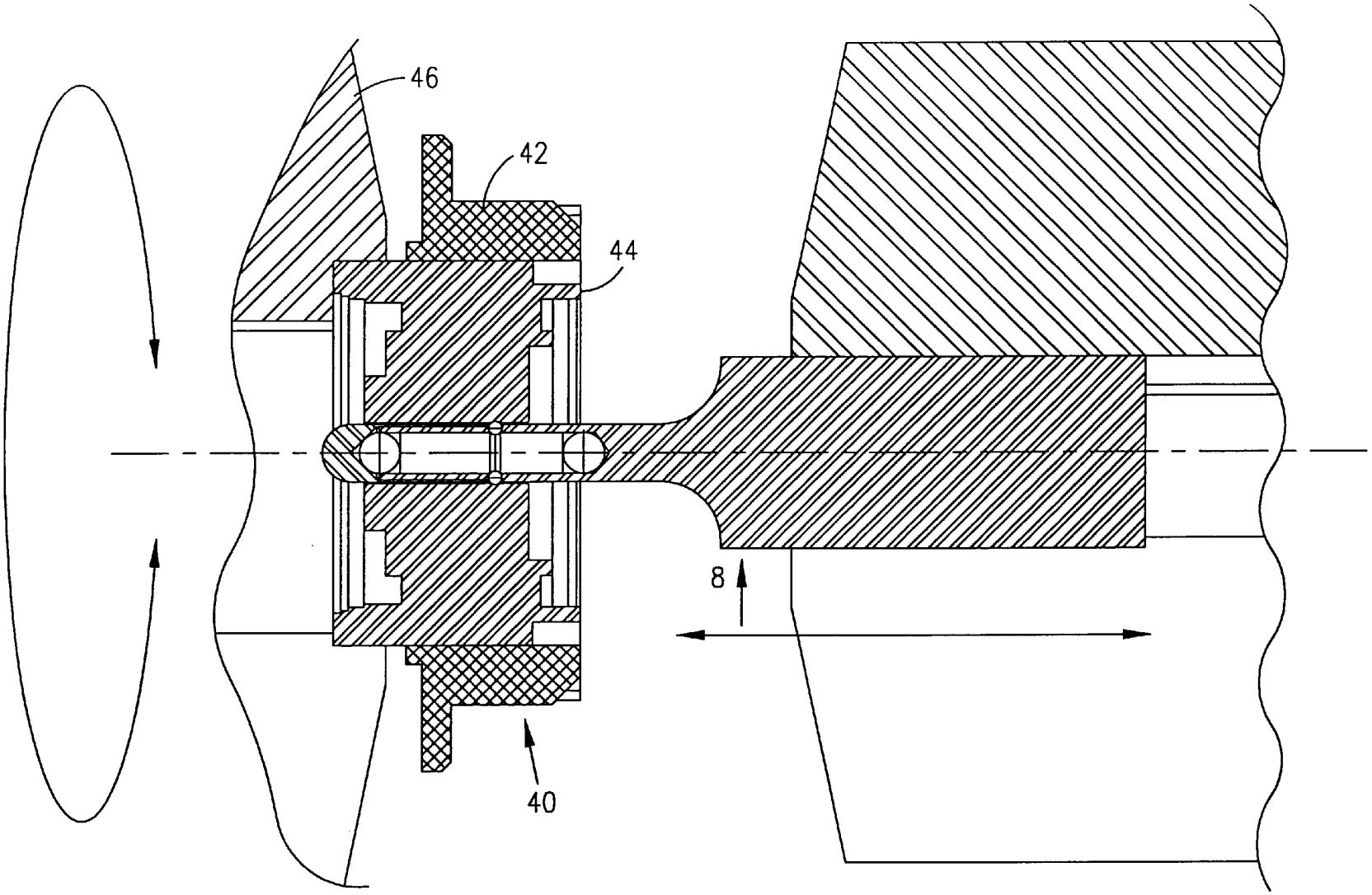
FIG. 4 is a vertical sectional view of the Seagate device shown together with the workpiece, and further illustrating the process for forming grooves in the workpiece including the apparatus for providing relative translation and rotation.

The method for forming grooves in a workpiece 40 can be most easily understood by referring to FIG. 4. In this particular example, the workpiece is a hub 42 and sleeve 44 assembly which has been premachined, so that it may be assembled into a finished spindle motor for a disc drive. However, the tool and method to be described are equally useful in forming grooves in workpieces or bushing having other uses as hydrodynamic bearings. As shown here workpiece 40 is chucked in a lathe spindle 46. The lathe used and illustrated herein is a standard production CNC lathe with fully contouring spindle, one of several such lathes which are useful in accordance with the invention. This process is clearly not limited to use with a particular type of lathe, but its use herein demonstrates the economical form of manufacture available with this device and method. It is preferable that the workpiece 40 be held by its outer diameter opposite to the thrust bearing cavity 50 (FIG. 3B) which is to be finished using this device and method.

As a preliminary step, the cavity 50 in workpiece 41 is bored to dimensions fit for grooving. To carry out the grooving process, the spindle 46 rotates the workpiece 40 as represented by arrow 52, while the device 8 is translated by a turret 54. The shape of the grooving pattern is defined by a combination of the rate of workpace rotation and the rate of axial tool translation. Many suitable grooving patterns are achievable, even in materials as hard as steel or the like. The number of bearing grooves formed in a single pass of the tool corresponds to the number of balls used. The pitch of these grooves depends on the ratio between the translational velocity $V_k$ and the rotational velocity $\Omega_k$ by varying this ratio, grooves of varying pitch can be obtained.

To form grooves in steel, it is especially important that the grooving pattern has no sharp discontinuities or abrupt changes in direction. However, this same device and method may be used to form grooves in other softer materials, forming herringbone patterns which are typical of other hydrodynamic bearings. When working with such softer materials, the direction of rotation may be sharply changed after completing a specific distance of travel.

The dimensional combination of the diameter of the pin 12, the geometry of the circumferential groove 18, the grooving ball 14 diameter, and the diameter of the bore 50 to be grooved define together with the Young's modulus of the pin 12 and the yield strength of the workpiece to be grooved the final depth of the grooves. Stresses and loads may be calculated using Hertz-point-contact equations and stress-strain curves.

Other materials of substantial hardness may be used for the pin and or the balls 14 and successful grooving of steel or other hard materials having long life characteristics be achieved without departing from the scope of this invention. The scope of the present invention is to be limited only by the following claims.

We claim:

1. An apparatus for forming grooves in the surface of a workpiece, the apparatus comprising a cage having a circular cage wall with an annular pattern of holes in said wall;

a plurality of spherical balls, each rotatably disposed in a respective hole of said cage wall and having a diameter greater than said wall thickness;

a pin located within said cage, said pin having a circumferential groove in a plane coincident with said plurality of spherical balls and holes in said cage wall so that said pin holds said balls in said groove, said balls protruding through said cage wall and engaging the surface of a workpiece to be grooved so that said balls roll in said groove in said pin and, with solely rotational movement of said workpiece and solely translational movement of said apparatus, grooves are caused to be formed in the interior surface of said workpiece;

said apparatus further comprising means at either end of said pin for holding said pin against translational movement relative to said cage with movement of said apparatus and said workpiece so that only a rotational movement is imparted to said pin by rotation of said workpiece, an outer surface of said cage wall having a first, reduced outer diameter in the region of said cage extending from said groove in said pin to an open end of said cage, and a cap fitting over an open end of said cage and engaging one of said means for holding said pin against translational movement, said cap having a second inner diameter sufficiently larger than said first, outer diameter to fit over said outer diameter of said cage so that said cap and said cage overlie one another forming said apparatus in which said balls may rotate freely in said cage while holding said pin against translational movement along said axis.

2. An apparatus as claimed in claim 1 wherein an end region of said cap extends to a point adjacent said groove in said pin and is tapered to engage an outer edge of said spherical ball to hold said balls in said cage.

3. An apparatus as claimed in claim 2 wherein said reduced outer diameter of said cage includes a recess circumferential disposed about said cage, and adhesive for locking said end cap to said cage to hold said pin and said hardened grooving balls in their relative positions.

4. An apparatus as claimed in claim 1 wherein said balls are formed of carbide so that said apparatus may effectively groove steel and other hardened materials.

5. An apparatus as claimed in claim 1 wherein said pin is formed of approximately 16 percent cobalt, and 84 percent carbide so that said balls may effectively roll in said groove on said pin and form grooves in said workpiece of steel or other hardened material.

6. A method of forming grooves in an inner surface of a bore through a workpiece utilizing an apparatus for forming grooves in the surface of a workpiece, the apparatus comprising a cage having a circular cage wall with an annular pattern of holes in said wall;

a plurality of spherical balls, each rotatably disposed in a respective hole of said cage wall and having a diameter greater than said wall thickness;

a pin located within said cage, said pin having a circumferential groove in a plane coincident with said plurality of spherical balls and holes in said cage wall so that said pin holds said balls in said groove, said balls protruding through said cage wall and engaging the surface of a workpiece to be grooved so that said balls roll in said groove in said pin and, with movement of said workpiece and said apparatus, cause grooves to be formed in the interior surface of said workpiece;

said method comprising holding said pin against translational movement relative to said cage with movement of said apparatus and said workpiece so that only a rotational movement is imparted to said pin by rotation of said workpiece, and further comprising driving said workpiece only with a rotational movement and driving said cage solely in translation to form grooves on the interior bore of said workpiece.

7. A method as claimed in claim 6 wherein said grooves are formed without sharp discontinuities or abrupt changes in direction.

* * * * *